US007005635B2

(12) United States Patent
Ahern et al.

(10) Patent No.: US 7,005,635 B2
(45) Date of Patent: Feb. 28, 2006

(54) NEBULIZER WITH PLASMA SOURCE

(75) Inventors: Michael Ahern, Mountain View, CA (US); Howard M. Kingston, Pittsburgh, PA (US)

(73) Assignee: Metara, Inc., Sunnyvale, CA (US)

( * ) Notice: Subject to any disclaimer, the term of this patent is extended or adjusted under 35 U.S.C. 154(b) by 0 days.

(21) Appl. No.: 10/835,492

(22) Filed: Apr. 29, 2004
(Under 37 CFR 1.47)

(65) Prior Publication Data

US 2005/0173628 A1 Aug. 11, 2005

Related U.S. Application Data

(60) Provisional application No. 60/542,560, filed on Feb. 5, 2004.

(51) Int. Cl.
*H01J 49/10* (2006.01)
*H01J 49/04* (2006.01)

(52) U.S. Cl. ..... 250/288; 250/281; 250/282; 250/285; 250/286; 250/287; 250/292

(58) Field of Classification Search ..... 250/251, 250/282, 285–288, 292
See application file for complete search history.

(56) References Cited

U.S. PATENT DOCUMENTS 4,842,701 A * 6/1989 Smith et al. ..... 204/451
4,902,099 A * 2/1990 Okamoto et al. ..... 356/316
4,933,650 A * 6/1990 Okamoto ..... 333/99 PL
4,977,320 A * 12/1990 Chowdhury et al. ..... 250/288
5,086,255 A * 2/1992 Okamoto et al. ..... 315/111.21
5,725,153 A * 3/1998 Wang et al. ..... 239/102.1
5,848,751 A * 12/1998 Wang et al. ..... 239/420
6,126,086 A * 10/2000 Browner et al. ..... 239/102.1
6,469,297 B1 * 10/2002 Kato ..... 250/288
6,596,989 B1 * 7/2003 Kato ..... 250/288
6,649,907 B1 * 11/2003 Ebeling et al. ..... 250/288
2002/0121599 A1 * 9/2002 Kato ..... 250/288
2002/0125425 A1 * 9/2002 Kato ..... 250/288
2005/0173628 A1 * 8/2005 Ahern et al. ..... 250/288

OTHER PUBLICATIONS

<uniwinnipeg>, "Bernoulli's Principles", <http://theory.uwinnipeg.ca/mod_tech/node68.html>.*
<wolfram research>, "Bernoulli's Law", <http://scienceworld.wolfram.com/physics/BernoullisLaw.html>.*

* cited by examiner

*Primary Examiner*—John R. Lee
*Assistant Examiner*—Bernard E. Souw
(74) *Attorney, Agent, or Firm*—Jonathan W. Hallman; MacPherson Kwok Chen & Heid

(57) ABSTRACT

A combination electrospray/microwave induced plasma (MIP) ionization source is used as the ionization source for a mass spectrometer. The electrospray can be operated in positive mode, negative mode, or it can be switched off. The microwave-induced plasma can also be switched on or off. This allows the instrument to be operated in multiple modes. With the electrospray off and the MIP on, the instrument will normally have its maximum elemental sensitivity. Mixed mode operation potentially allows the determination of additional information about the chemical constituents present in the analyte. In pure electrospray mode, it is possible to obtain molecular information and to analyze organic compounds.

19 Claims, 6 Drawing Sheets

NEBULIZER WITH PLASMA SOURCE

CROSS REFERENCE TO RELATED APPLICATION

The present application claims priority to provisional application Ser. No. 60/542,560, filed Feb. 5, 2004, which is incorporated by reference in its entirety.

BACKGROUND

1. Field of the Invention

The present invention relates to chemical analysis using mass spectrometers, and in particular to mass spectrometers using a plasma and an electrospray ionization source.

2. Related Art

Mass spectrometers and other systems are used for measurement of the concentration of analytes or the detection and measurement of contaminants and trace additives in solutions and gases. As one example in the field of semiconductor processing, process solutions for wafer cleaning, etching and other forms of surface preparation are routinely analyzed using mass spectrometers with plasma ionization sources, one type is an inductively coupled plasma mass spectrometer (ICP-MS). The measurements made by ICP-MS are used to determine and manage the quality of process solutions. Ultrapure water (UPW), dilute hydrofluoric acid (HF), and standard industry clean formulations SC1 (Standard Clean 1, ammonium hydroxide and hydrogen peroxide in water) and SC2 (hydrochloric acid and hydrogen peroxide in water) are examples of solutions that are routinely analyzed. Quick and accurate analysis in these and other industrial processes can result in the early detection of contamination problems, better control of process chemistry, and ultimately lead to higher yields and less product variation.

In general, mass spectrometry is often used to achieve sensitivity of parts per billion (ppb) or parts per trillion (ppt). It is commonly used to quantitatively measure the amount of contamination present or the concentration of a constituent in the solution. For example, commonly-assigned U.S. patent application Ser. No. 10/004,627, which is incorporated by reference in its entirety, discloses an automated analytical apparatus measuring contaminants or constituents present in trace concentrations using a form of Isotope Dilution Mass Spectrometry (IDMS) and an electrospray ionization source. In the IDMS technique, a sample of interest is spiked with a known amount of an appropriate isotopic species. This spike is to be used as an internal standard during the mass spectrometry measurement. In this technique, the relative ratios of peak areas present in the mass spectra of the sample species of interest and the isotopically enriched calibrated spike are used to determine the concentration of the chemical constituents of interest in the sample.

Two modes for analyzing samples are used in the analysis method of this patent application: speciation mode and elemental mode. These modes are enabled by an electrospray ionization source. For applications that require molecular information, an electrospray ionization source is often used, such as disclosed in U.S. Pat. No. 6,060,705 entitled "Electrospray and Atmospheric Pressure Chemical Ionization Sources", which is incorporated by reference in its entirety. This type of source provides a "soft" ionization (i.e., occurring at lower energy) in which molecular information is retained. This information is required for the successful identification of organics and molecular complexes that may be present in a process solution or gas. In speciation mode, collisions between the ions and other molecules are relatively soft, leaving the majority or major fractions of the structure of the original molecule intact.

On the other hand, in elemental mode, the collisions are much more energetic ("harder") through the creation of more highly accelerated ions (with higher energy) that break the molecular species into their elemental or individual atomic components. However, the energetics present in the electrospray ionization source are not sufficient to break all components of the molecular species that may be present into their elemental components even in the hard ionization mode. The elemental sensitivity when using this type of source is limited by the fact that elemental species are distributed in a number of molecular fragments even after ionization. In this case, all peaks containing the element must be identified and analyzed after background subtraction if the optimum sensitivity is to be obtained. If, however, the analyte is fully ionized to its elemental components, an elemental ion of a given type will be concentrated into one peak that is relatively easy to identify and analyze without the errors associated with multiple peak fittings and background subtractions that must occur for the former case.

Another shortcoming of the electrospray source is its degraded ionization efficiency for some species including metals in the presence of strongly acidic or basic solutions. This degradation significantly reduces the sensitivity for trace contamination and other constituents that are important for successful measurement of the analyte.

Therefore for elemental quantification and ultimate detection limits, an inductively coupled plasma (ICP) ionization source is often preferred due to its ability to completely break molecules into their elemental components. Strong acids and bases are also effectively neutralized in the plasma, another important feature. An ICP source works in general by coupling radio frequency (RF) energy into a gas stream containing the nebulized liquid or gas sample with the result that the sample is immediately heated to several thousand degrees. Molecules break apart at these temperatures and collision energies leaving only elemental ions. Since this technique breaks all of the molecular bonds, this ionization technique can provide very high elemental sensitivity; however, all molecular information is lost. ICP sources that are currently available for sample ionization are too large and intrusive for successful integration into current electrospray mass spectrometry systems.

Another way to generate plasma for ionization purposes is with the use of a microwave induced plasma (MIP) source. It is well known that microwave energy, a higher frequency radiation than that used in ICP-MS instruments, is capable of inducing plasma that can successfully ionize analytes into elemental components for mass spectrometry analysis. There is extensive discussion of prior art in U.S. Pat. No. 5,051,557, entitled "Microwave Induced Plasma Torch with Tantalum Injector Probe" by Stazger and in an article by Yongxuan Su, Yixiang Duan and Zhe Jin entitled "Helium Plasma Source Time-of-Flight Mass Spectrometry: Off-Cone Sampling for Elemental Analysis," published in *Analytical Chemistry,* Vo. 72, No. 11, Jun. 1, 2000, pp. 2455–2462. Both are incorporated by reference in their entirety.

A microwave source, due to its shorter wavelength, can be made significantly smaller than commercially available ICP sources normally used in mass spectrometry. The smaller size makes its integration into an electrospray ionization source mass spectrometer instrument possible while keeping the electrospray source operational as an alternative ionization source, i.e., the mass spectrometer can then be operated with an electrospray ion source or a microwave induced plasma ion source or a combination of the two.

For many applications, such as the measurement and control of semiconductor cleaning baths or processing gases, the ability to analyze for organics and species as well as high elemental sensitivity is highly desirable. Metals incorporated into semiconductor devices can affect device parameters, reliability, and yield. Knowing the oxidation state or molecular binding provides root cause source information. Organics deposited on wafer surfaces can affect transistor gate oxide thickness control and gate oxide reliability. It is desirable to have as low a detection limit as possible for metal contaminants while still having the ability to analyze molecular species present in process solutions.

Therefore, there is a need for a mass spectrometer system that overcomes the deficiencies as discussed above with conventional systems.

SUMMARY

One aspect of the present invention provides the integration of a plasma ionization source and an electrospray ionization capability in a mass spectrometer such that the different ionization sources can be operated independently or together to achieve sample ionization in the way that is optimal for the analytical need at hand. One embodiment makes use of a microwave-induced plasma (MIP) source for this purpose due to its relatively small size, successful ionization characteristics, and a lower power dissipation. The present invention enables operation without compromise to either method of ionization and provides the ability to switch from one ionization source to another under electrical and software control without any hardware changes.

In one embodiment, there are three modes of operation for the combined electrospray/MIP ionization source instrument:

1) MIP source on, electrospray off. In this mode, a liquid or gas is delivered to a nebulizer which forms an uncharged spray when mixed with a carrier gas, which could be Ar, He or $N_2$. The MIP source is energized and provides the ionization necessary for MS analysis.
2) MIP source off, electrospray on. In this mode, the MIP source is not energized, and invisible with respect to the normal operation of the electrospray source for ionization. In this case, the electrospray provides the ionization required for MS analysis.
3) MIP on, electrospray on. In this mode, the electrospray ionization source will act as a selectivity mode for desired analytes. The electrospray will select either positive or negative ions and the MIP will fragment them completely to their elemental components.

According to one aspect of the invention, a mass spectrometer contains a plasma source coupled to an electrospray ionization source via a capillary or tube. The plasma source in one embodiment is an inductively coupled plasma (ICP) source and in another embodiment is a microwave induced plasma (MIP) source.

By combining a "soft" ionization source, such as electrospray, with a "hard" ionization source, such as plasma ionization, into one instrument, rapid switching from high sensitivity elemental analysis to molecular analysis mode is enabled in the same instrument near live time and enabling the three distinct modes of operation described above.

In one embodiment, a microwave plasma source is placed in series between the sample introduction or spray chamber and the mass spectrometer. A quartz capillary or tube of other usable material runs from the sample introduction or spray chamber that is normally at atmospheric pressure, through the center of the microwave cavity and into the entrance of the mass spectrometer that is at a pressure reduced from atmospheric. The liquid or gas sample is injected through either the electrospray needle or through a nebulizer into the sample introduction chamber. The quartz tube has a smaller inside diameter at its opening into the sample introduction chamber and then opens up into a larger diameter inside the microwave cavity and may or may not close back down to a smaller diameter at the other end or entrance to the mass spectrometer. As result of this arrangement, there will be a reduced pressure region in the microwave plasma generation area relative to the sample introduction chamber. The reduced pressure allows the plasma to light without the need for an electric spark or other catalyst and the plasma can be more easily sustained during operation. In one embodiment, the dimensions of the quartz tube are as follows: an outside diameter (OD) of 6.5 mm and a length of 10 cm, with the end at the sample introduction end portion having an inside diameter (ID) of 0.5 mm and a length of 4 cm, and the second portion having an ID of 4 mm and a length of 6 cm (initiating just before the plasma generation region and ending at the entrance to the mass spectrometer region).

The larger inside diameter of the middle portion acts as a pressure reducer in the region where the plasma is generated and the ionization takes place. The small entrance portion of the capillary is large enough to allow an aerosol to pass through without coating the inside of the tube, but small enough to result in a significant pressure differential between the sample introduction chamber and the plasma region. The addition of the MIP source requires a relatively simple mechanical interface. The addition to the length of the overall tool is a fraction of the length of the original sample introduction chamber, keeping the size of the combined sources manageable.

In the third mode (i.e., MIP on, electrospray on), the electrospray can be adjusted to create either positive or negative ions that will be preferentially attracted to the entrance of the capillary due to the positive or negative voltage applied between the electrospray and the electrode surrounding the end of the capillary during normal operation. In this mode, it may be possible to introduce certain species preferentially for analysis while reducing the introduction of others. This has the potential for minimizing spectral background and interferences for selected species. The ions and the neutrals that enter the capillary will be driven into the reduced pressure region where the microwave-induced plasma is formed. Normal MIP ionization will then occur as in the first and second modes.

In summary, the present invention enables detection of atomic species to parts per trillion (ppt), and potentially beyond, by the use of a relatively low power, small plasma ionization source that can be compatibly inserted between an electrospray source and the entrance to a mass spectrometer. The electrospray mode that enables complementary molecular analysis capability remains fully operational. It also enables the use of plasma ionization for the breakdown of strong acidic or basic solutions for trace metals analysis that is difficult and sometimes impossible with electrospray ionization sources.

Thus, the present invention provides molecular specie detection, identification and quantitative analysis as well as ultimate analytical sensitivity for trace metals. The benefits of both high sensitivity elemental analysis (ICP ionization, for example) with the ability to perform molecular analysis at the same time or nearly the same time (electrospray ionization source, for example) is combined into one system. An advantage of having both modes present is that with the plasma source turned on, there is a high elemental sensitivity, allowing for the detection and measurement of trace metal concentration. With the electrospray sourced turned on and the plasma source turned off, molecular species will remain largely intact for analysis in the mass spectrometer allowing for the detection and identification of molecular and organic species and contaminants and their quantitative analysis in the analyte. The ability to analyze full molecular species in the electrospray ionization mode provides information that enables the identification of the origin of trace metal or any other contaminants present in the analyte.

This invention will be more fully understood in conjunction with the following detailed description taken together with the following drawings.

BRIEF DESCRIPTION OF THE DRAWINGS

Use of the same or similar reference numbers in different figures indicates same or like elements.

DETAILED DESCRIPTION OF THE PREFERRED EMBODIMENTS

Figure 1:
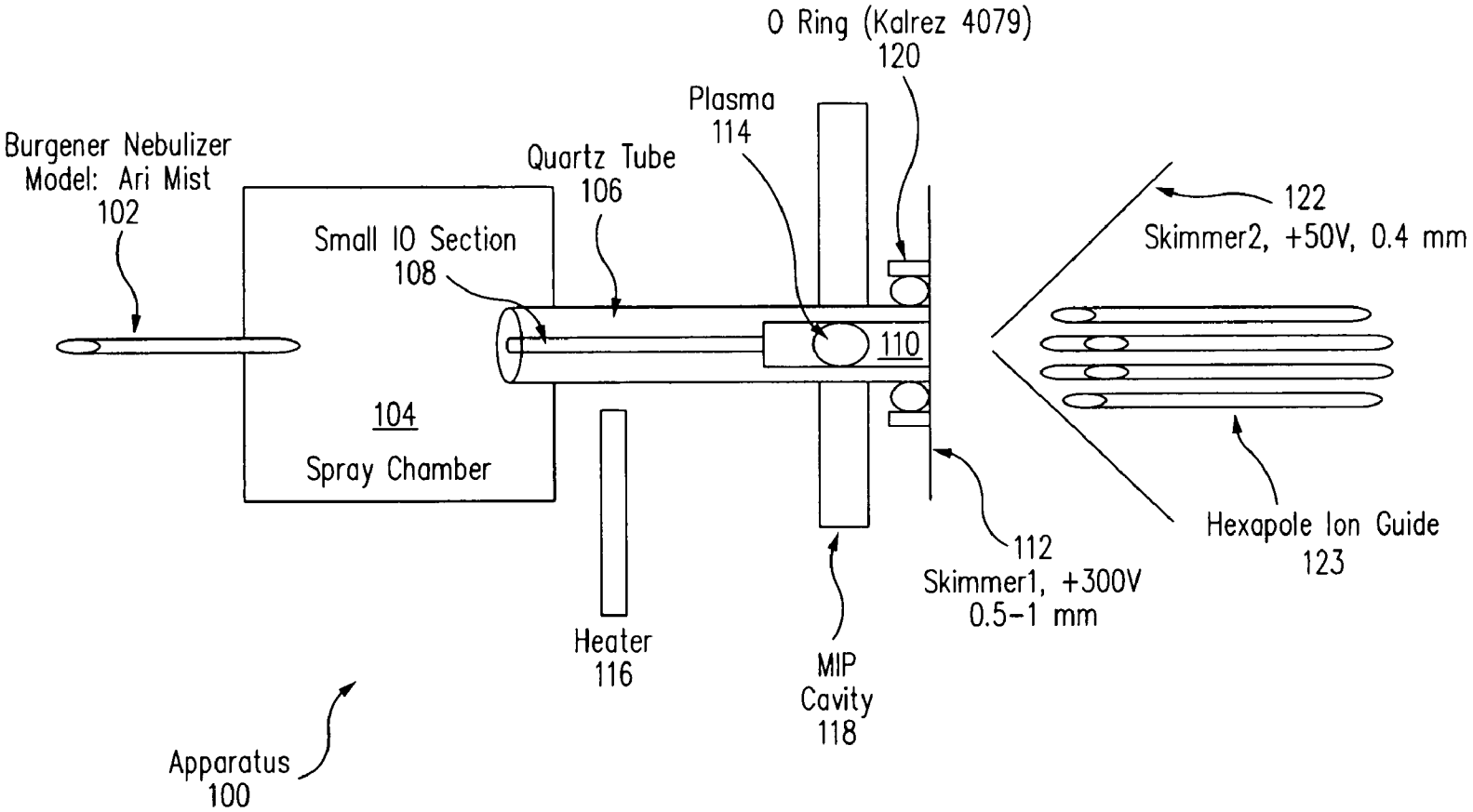
FIG. 1 shows a portion of a system for analyzing gases and chemical solutions according to one embodiment of the present invention.

FIG. 1 is a diagram showing a portion of an apparatus 100 for analyzing gases and chemical solutions according to one embodiment of the present invention. Apparatus 100 includes an electrospray needle or nebulizer 102 that directs nebulized liquid into a sample introduction or spray chamber 104 at atmospheric pressures. In one embodiment, spray chamber 104 may be filled with helium and an aerosol that could be highly acidic. Electrospray needle 102 may be one built by Analytica of Branford or may alternatively be a Burgener nebulizer (e.g., an Ari Mist model), in which the electrospray is used as an atomizer and is not energized electrically. The nebulized liquid is drawn from a sample of solution to be analyzed, such as a SC2 or UPW bath. The nebulized aerosol is formed by combining a carrier gas, such as argon, helium, or nitrogen, with the analyte to form a spray.

In one embodiment, the pressure of the carrier gas as it is introduced into electrospray needle 102 is approximately 60 to 120 psi. This results in a gas flow rate of approximately 200 standard ml/min through the output of the nebulizer needle. The incoming liquid flow rate (of the analyte) is approximately 5 to 75 microliters/min. For example, if the apparatus were operated in the mode where both the electrospray and the plasma source were active (as will be discussed below), electrospray needle 102, at ground potential, expels a spray of nebulized liquid into the sample introduction chamber atmospheric pressure. Upon expulsion, the droplets experience an electric field, causing explosions which break down the droplets and release the ions. The ions are then drawn toward the entrance of a capillary or quartz tube 106 by an electric field (for example from a charge of −5 kV to −6 kV at the entrance of the quartz tube). Further, in one embodiment, heated $N_2$ or He gas is introduced around the entrance of quartz tube 106 to drive off residual solvent molecules.

Such processes are known, such as described in U.S. Pat. No. 6,060,705, referenced above. Alternatively the electric field between the electrospray needle and the capillary opening can be turned off and the electrospray needle used as a nebulizer. In this case the spray that is produced is not ionized and the MIP source will be energized and be the ion generation source for the analyzer.

In another embodiment, an additional nebulizer or nebulizers are located in the sample introduction or spray chamber 104. These nebulizers (not shown) may be used to produce an aspirated spray of the analyte for introduction into tube 106 as an alternative to using the electrospray source.

As seen from FIG. 1, quartz tube 106 has a first end portion 108 and a second end portion 110. First end portion 108 is inserted into sample introduction or spray chamber 104 for receiving the samples to be analyzed, and second end portion 110 is adjacent to a first skimmer 112. In one embodiment, quartz tube 106 has an outside diameter of approximately 6.5 mm and a length of approximately 10 cm. The first portion 108 of tube 106 starting from sample introduction chamber 104 has an inside diameter of approximately 0.5 mm and a length of approximately 4 cm, while second portion 110 has an inside diameter of approximately 4 mm and a length of approximately 6 cm. Thinner diameters may result in deposition along and subsequent cross-contamination from the sides of the capillary, while larger diameters would require longer tubes to maintain the necessary pressure differential, thereby increasing the overall size of the apparatus. The small inside diameter of first end portion 108 reduces the pressure of the ion stream as it passes through first end portion 108 and into second end portion 110, where a plasma 114 is generated.

This reduction in pressure of the gas stream upon entering the second portion 110, allows a more stable plasma to be generated at a lower energy, for example at 120 W. In conventional sources in which the sprayed analyte reaches the plasma generation area at atmospheric pressure, plasma generation is more difficult to light and to keep lit. Further, the smaller inside diameter of first end portion 108 is large enough to allow the analyte spray to pass through without coating the inside of the tube, but small enough to keep the length short and maintain a small overall size for combined source chamber and MIP apparatus. In another embodiment, the quartz capillary tube is heated to minimize water content in the plasma. Any suitable heater can be used, such as a heater 116 positioned adjacent a portion of first end portion 108 capable of temperatures up to approximately 100° C. The heater or heaters can help in reducing or eliminating water droplets within the tube that can diminish the effectiveness of the plasma.

Another method of desolvating the aerosol before it reaches the plasma generation area is to direct a heated drying gas into the spray inside the sample introduction chamber. The gas used is typically nitrogen or helium.

In FIG. 1, the second portion 110 of the capillary is positioned in the plasma generation region 114 of a plasma generation source 118, which in one embodiment is an MIP source microwave cavity, such as a Beenakker Microwave Cavity from Opthos Instruments, Inc. of Maryland. In one embodiment, a conventional microwave power supply (not shown) is coupled to the plasma generation source 118. This source is able to deliver up to 300 W at a frequency of 2.45 GHz to the cavity to a generate plasma at 50 Torr. Higher powers may also be suitable with some analytes and different hardware construction materials. In other embodiments, the plasma is generated between two skimmer plates or cones. An inductively coupled plasma (ICP) source can be used as an alternative, once the technology has advanced to the point where small suitable sources as in the MIP case, are available.

In one embodiment, the end of second end portion 110 is secured or sealed the first skimmer plate 112 (Skimmer1) by an O-ring 120. The O-ring is made from a material called Kalrez 4079, which is used in industry for plasma applications and has been reported to be useable in temperatures up to 600° F. With this type of O-ring, the power supplied is to be no more than 200 W, since higher energy levels are likely to degrade the O-ring, resulting in seal leakage.

In one embodiment, the distance between first skimmer plate 112 and the center of the plasma is approximately 12 mm. Further, first skimmer plate 112 has an opening that lets ions pass from quartz tube 106 to a skimmer cone 122 (Skimmer2). In one embodiment, the opening is approximately 0.5 to 1 mm in diameter.

In this embodiment molecules and/or ions from the nebulized or ionized analyte will travel through the capillary from the spray chamber into the capillary and on into the plasma zone 114 where all species will in general be fully ionized if the plasma is on. The pressure difference between sample introduction chamber 104 and the vacuum present in a hexapole ion guide 123 portion of the mass spectrometer provides the driving force for movement of the analyte, whether it is in ionized form or not, and some carrier and heating gas, through the capillary, into the plasma generation region and into the entrance of the mass spectrometer at the end 110 of the capillary tube 106. Ions generated in the plasma or earlier in the electrospray will exit the quartz tube and enter skimmer cone 122. A large voltage difference between the capillary exit and the skimmer cone entry causes collisions between the ions and collision gas molecules, with ions then entering hexapole ion guide or trap 123. This provides an additional mode of ionization as an assist to electrospray ionization for electrospray only operation (standard electrospray ionization mass spectrometry procedure). Ions then enter the hexapole ion guide where ions in the mass range of interest are retained, while allowing other ions and neutrals to escape.

Ions enter the mass spectrometer, such as a time-of-flight mass spectrometer from Analytica of Branford, Conn. The charge-to-mass ratio of all captured ions is then measured per normal mass spectrometry procedures. Constituents and contaminants present in the analyte are identified. In a time of flight analyzer as mentioned herein, a pulser imparts each packet of ions with the same kinetic energy. As the ions drift through the analyzer, the ions separate based on their masses, with lighter ions traveling faster than heavier ions. At the end of the drift tube, ions are reflected by an ion mirror back to towards a detector plate at the top of the drift tube. Lighter ions hit the detector first, and by determining the time of ion arrival, the mass of different ions is determined.

Figure 2:
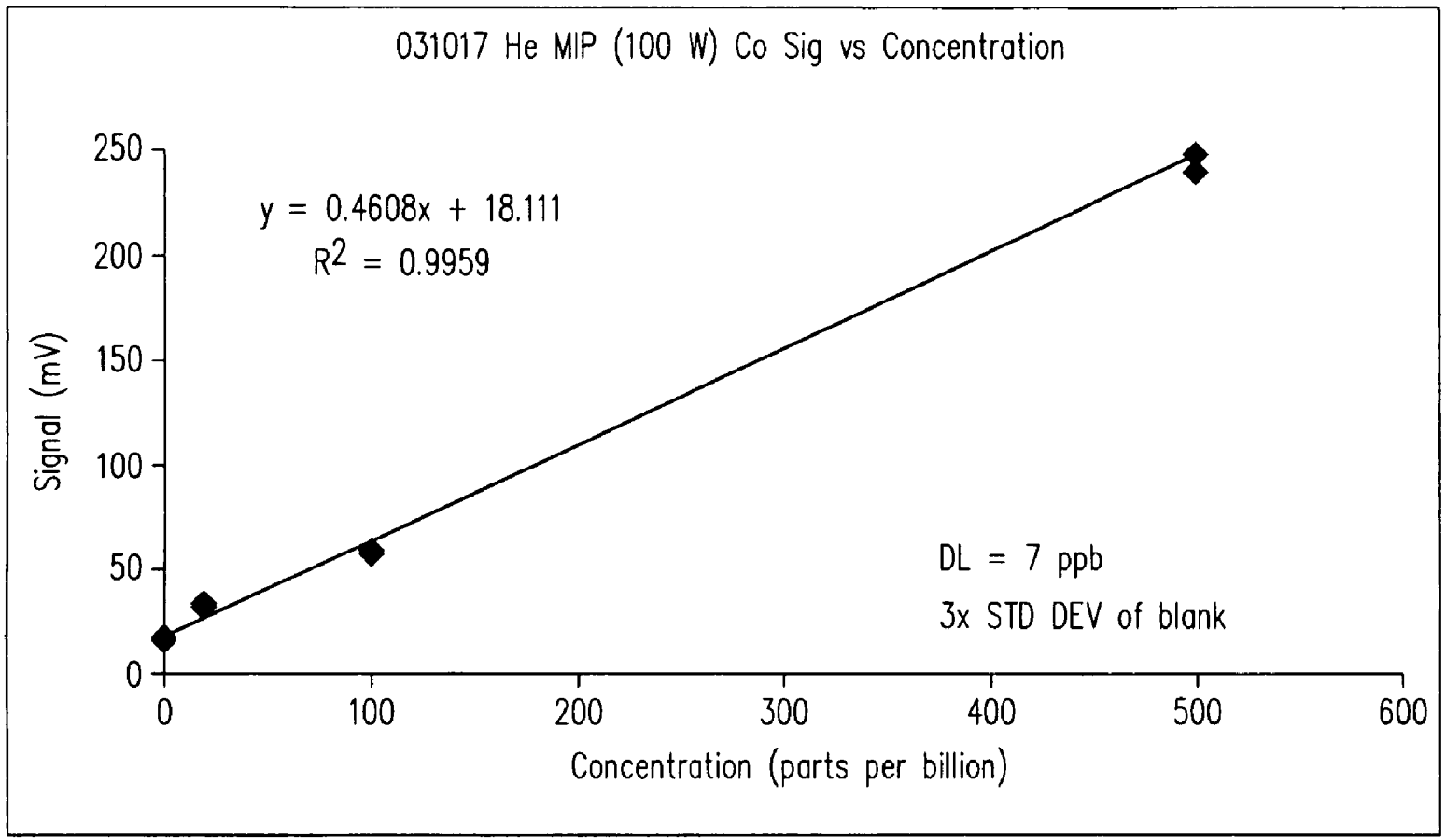
FIG. 2 shows a 2 sample calibration curve for cobalt using the present invention.
Figure 3:
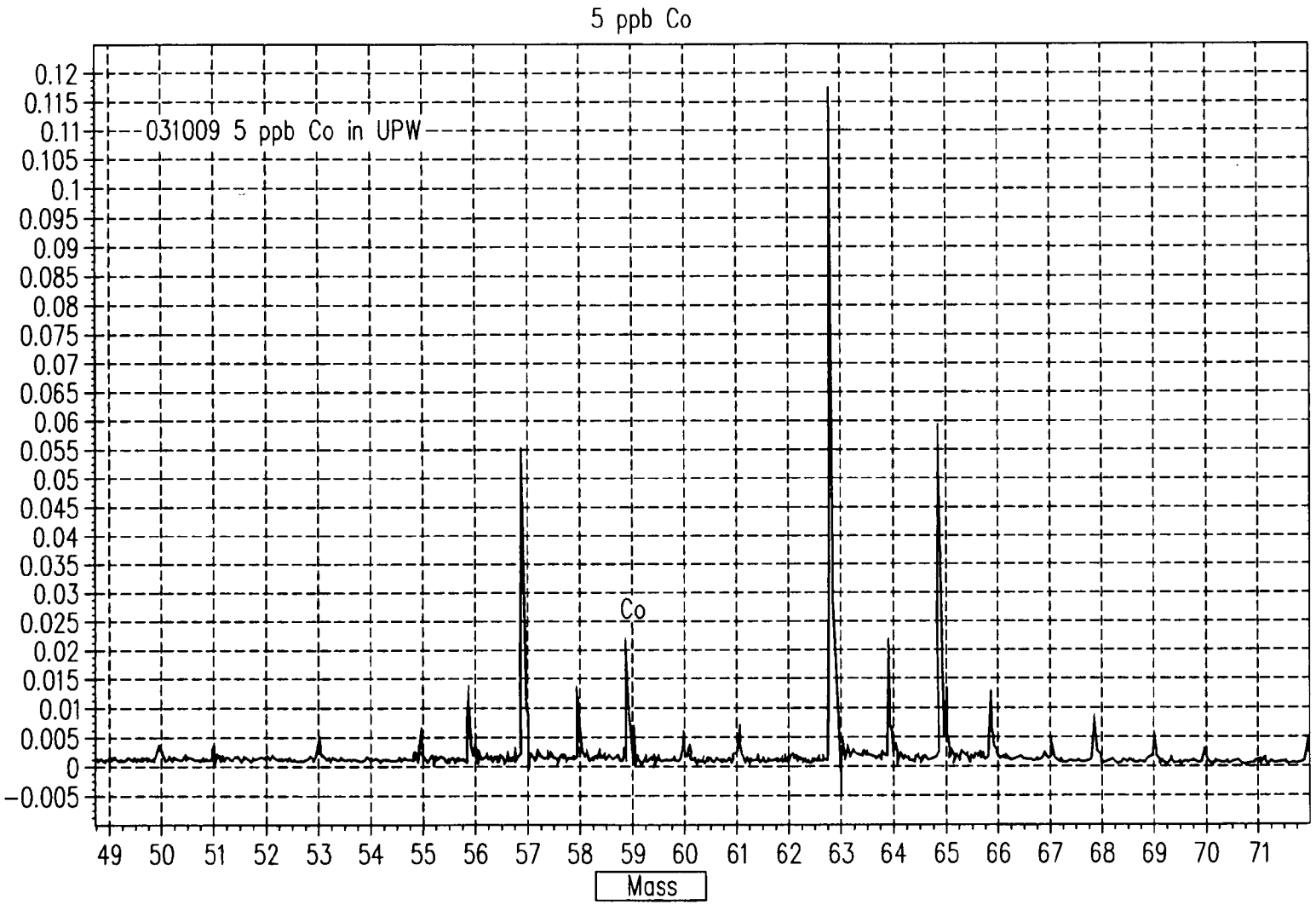
FIGS. 3, 4, and 5 are examples of cobalt mass spectra for different solutions using the present invention.
Figure 4:
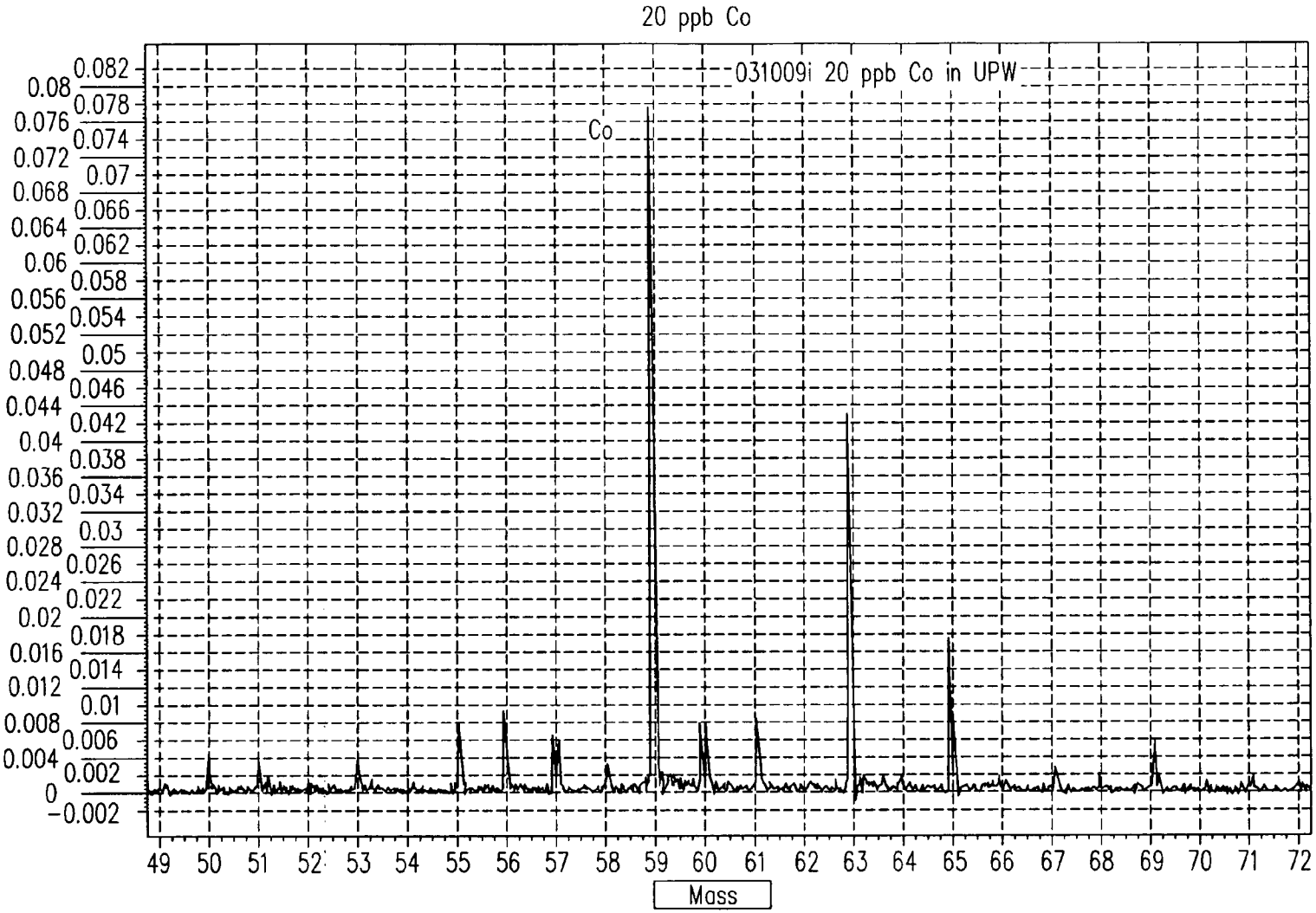
Figure 5:
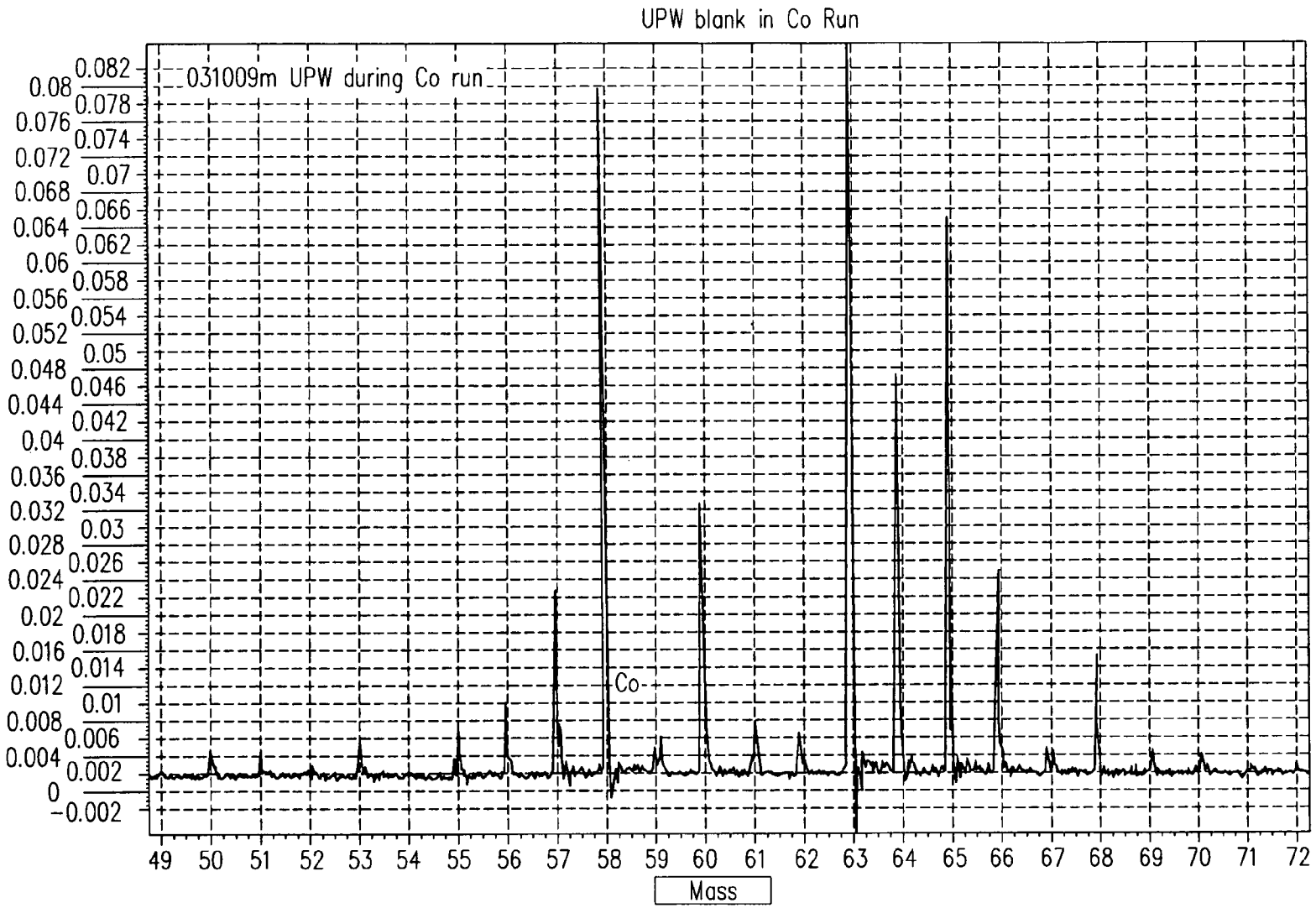

In normal usage, data is compiled and analyzed to determine the composition and/or trace contamination present in the analyte. Sensitivities for trace constituents including organic species, molecules and trace metals such as Cu, Cr, Zn, Ni, and Co down to a one part per trillion (ppt) and beyond are potentially possible. UPW, HF, SC1, SC2 and other process chemistries can be analyzed. Constituent concentration or contamination levels can be quantified through IDMS or other suitable methods. IDMS combines the sample with an isotopically enriched calibrated spike. The spike serves as the calibration reference for determining the analytes by comparing relative ratios. FIG. 2 shows a calibration curve for cobalt using the present invention, and FIGS. 3–5 show the spectrum for various samples, with the cobalt spike labeled.

Figure 6:
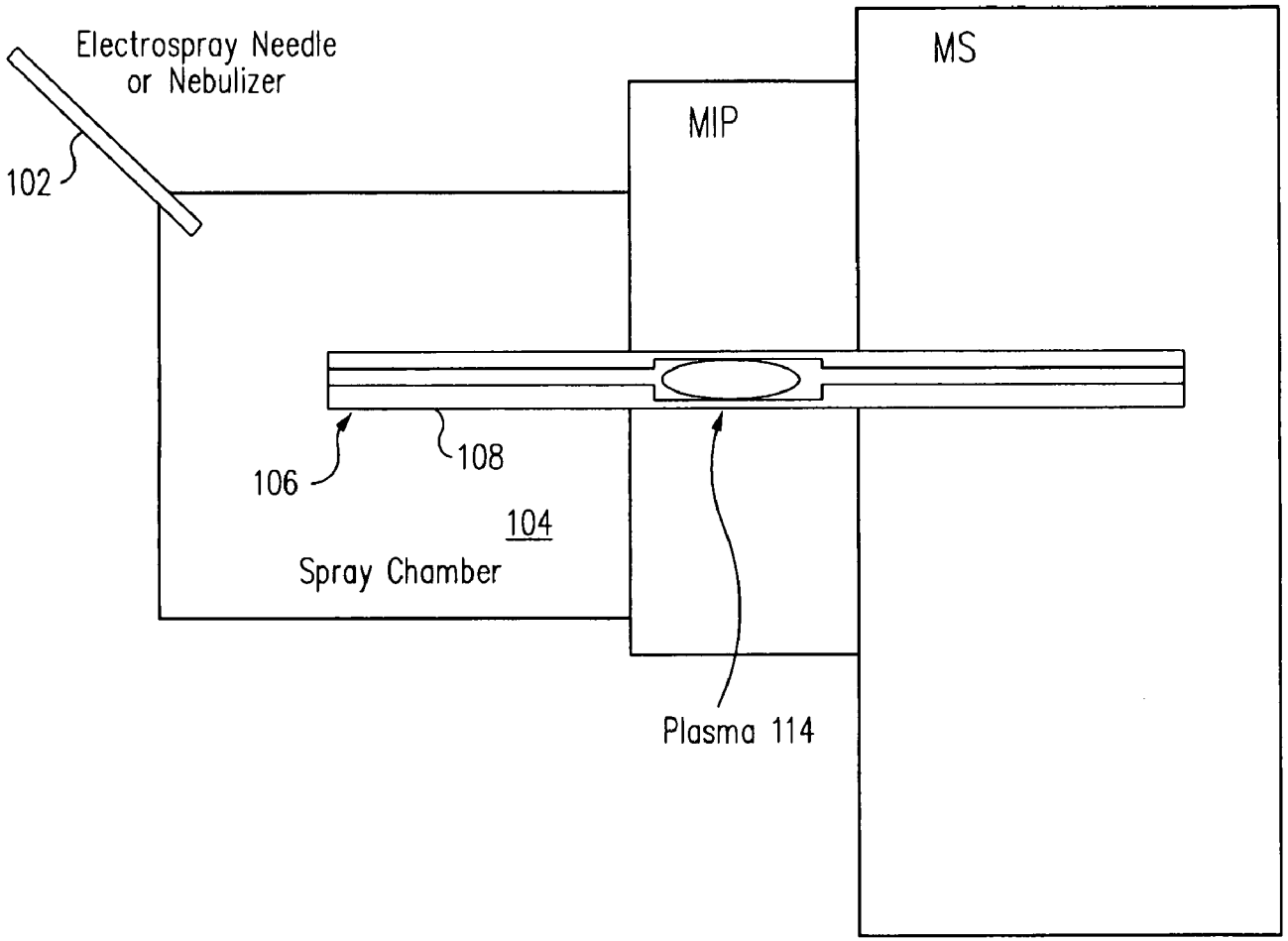
FIG. 6 shows a portion of the system of FIG. 1 according to another embodiment.

FIG. 6 shows another embodiment of the present invention, wherein the capillary or tube 106 includes a third portion 600 extending from second portion 110 into a mass spectrometer 602. Third portion 600 has a narrower inside diameter than second portion 110. In one embodiment, tube 106 is approximately 28 cm in length, with first portion 108 having an inner diameter of 0.6 mm and a length of 4 cm, second portion 110 having an inner diameter of 4 mm and a length of 4 cm, and third portion 600 having an inner diameter of 0.6 mm and a length of 20 cm.

In the embodiments discussed above, a "soft" ionization source, such as electrospray, is combined with a "hard" ionization source, such as plasma ionization, are incorporated into a single mass spectrometer enabling the best features of each source to be incorporated into one analytical instrument. This enables rapid switching from a high sensitivity elemental analysis mode to a molecular analysis mode within the same instrument and enables operation in three distinct modes for the analysis of chemical solutions or gases.

Referring back to FIG. 1, in the first mode, plasma or MIP source 118 is on, while the electrospray source is off with apparatus 100 for generating atomic species. In this mode, apparatus 100 operates like a standard plasma source mass spectrometer. The liquid or gas is delivered to nebulizer 102 which forms an uncharged spray when mixed with a carrier gas, such as, but not limited to Ar, He or $N_2$. MIP source 118 is energized and provides the ionization necessary for mass spectrum analysis. In the second mode, MIP source 118 is off, while the electrospray source on for generating molecular species. In this mode, apparatus 100 operates like a standard electrospray mass spectrometer. Because the MIP source is not energized, it is invisible with respect to the normal operation of the electrospray source for ionization. In this case, the electrospray provides the ionization required for mass spectrum analysis. In the third mode, both MIP source 118 and the electrospray source are on. In this mode, the electrospray ionization source will act as a selectivity mode for desired analytes. The electrospray will select either positive or negative ions and the MIP source will fragment them completely to their elemental components. Thus, in the first mode, the nebulizer needle is used for aspiration of the incoming solution into the sample introduction chamber, and in the second and third modes, the electrospray needle is used to aspirate fluid into the chamber. Gas injection can potentially be through either source.

The above-described embodiments of the present invention are merely meant to be illustrative and not limiting. It will thus be obvious to those skilled in the art that various changes and modifications may be made without departing from this invention in its broader aspects. Further, the quartz tube does not need to only have one inner diameter and one outer diameter or to even be quart for that matter. Also other methods may be suitable to reduce the pressure in the plasma generation region. Therefore, the appended claims encompass all such changes and modifications as fall within the true spirit and scope of this invention.

What is claimed is:

1. An apparatus for analyzing a chemical solution or gas, comprising:

an electrospray source;

an atmospheric pressure sample introduction chamber, wherein a sample can be introduced from the electrospray source;

a capillary configured to receive sample from the sample introduction chamber at a reduced pressure with respect to the atmospheric pressure in the sample introduction chamber;

a plasma source coupled to the capillary, wherein the reduced pressure in the capillary eases the production of plasma such that the sample in the capillary is ionized into elemental species if the plasma source is energized; and a mass spectrometer coupled to the capillary.

2. The apparatus of claim 1, wherein the electrospray source comprises a nebulizer.

3. The apparatus of claim 1, wherein the sample introduction chamber is a spray chamber.

4. The apparatus of claim 1, wherein the plasma source is a microwave induced plasma source.

5. The apparatus of claim 1, wherein the plasma source is an inductively coupled plasma source.

6. The apparatus of claim 1, wherein the plasma source comprises a power supply for generating power at 2.45 GHz.

7. The apparatus of claim 1, wherein plasma is generated at a power of approximately 120 W.

8. The apparatus of claim 1, wherein the capillary comprises:

a first portion having a first inside diameter; and a second portion having a second inside diameter larger than the first inside diameter, wherein the second portion is adjacent to the plasma source and wherein the first portion is between the sample introduction chamber and the second portion.

9. The apparatus of claim 8, wherein the first inside diameter is approximately 0.5 mm and the length of the first portion is approximately 4 cm.

10. The apparatus of claim 8, wherein the second inside diameter is approximately 4 mm and the length of the second portion is approximately 6 cm.

11. The apparatus of claim 8, wherein the capillary further comprises a third portion having a third inside diameter smaller than the second inside diameter, wherein the second portion is between the first and third portions.

12. The apparatus of claim 1, wherein the capillary is a quartz capillary.

13. The apparatus of claim 1, wherein the electrospray source is turned on and the plasma source is turned off for analysis of molecular species.

14. The apparatus of claim 1, wherein the plasma source is energized for analysis of atomic species.

15. The apparatus of claim 1, wherein either of the sources may be turned on with the other source turned off or both sources may be turned on.

16. A method of generating an ionized source for using in a mass spectrometer, comprising:

selecting either a soft ionization or a hard ionization analysis;

electrospraying a sample into an eletrospray chamber at atmospheric pressure to generate a softly-ionized sample;

reducing the pressure of a portion of the softly-ionized sample by passing it through a capillary; and if the hard ionization analysis is selected, further ionizing the softly-ionized sample to generate a plasma.

17. The method of claim 16, wherein the capillary includes two passages of different inside diameters to effect the pressure reduction.

18. The method of claim 16, wherein the plasma source is generated using a microwave induced plasma source.

19. The method of claim 16, wherein generating the plasma comprises applying no more than 300 W at 2.45 GHz.

* * * * *